United States Patent [19]

McCabe

[11] 4,447,972

[45] May 15, 1984

[54] LAUNDRY SPREADER, COUNTER, AND FOLDER

[76] Inventor: Stanley G. McCabe, 1318 Grinell, Lubbock, Tex. 79403

[21] Appl. No.: 330,941

[22] Filed: Dec. 15, 1981

[51] Int. Cl.[3] ..... D06C 3/02

[52] U.S. Cl. ..... 38/12; 38/7; 38/143

[58] Field of Search ..... 38/12, 7, 143

[56] References Cited

U.S. PATENT DOCUMENTS

| | | | |
|---|---|---|---|
| 3,604,132 | 9/1971 | Thompson et al. . | |
| 3,736,678 | 6/1973 | Kamberg | 38/143 |
| 3,791,057 | 2/1974 | Hall . | |
| 4,050,173 | 9/1977 | Olsen . | |
| 4,106,227 | 8/1978 | Allen et al. . | |
| 4,143,476 | 3/1979 | Holmes et al. . | |
| 4,313,269 | 2/1982 | van Rumpt et al. . | |

*Primary Examiner*—Werner H. Schroeder

*Assistant Examiner*—Andrew M. Falik

*Attorney, Agent, or Firm*—Hill, Van Santen, Steadman & Simpson

[57] ABSTRACT

A spreader, counter, folder and stacker for laundered articles. The articles are discharged as circulated about an elongated bin. Clips on an endless chain pick the articles up from the bin one by one and elevate them. The clips are released by a cam to drop the articles one by one on traveling catches which pull them for spreading and carry them over a retarded rotation brush. This places a drag on the articles and elongates them for transfer one by one to a spreader bar. A series of spreader bars are provided and each carries the article draped over the bar past the radial tine of a counter. As each article engages a radial tine a drive is energized to a brush conveyor and a counted stack of articles is stacked on the conveyor and discharged from the conveyor to be picked up for use.

17 Claims, 10 Drawing Figures

10
15
13
34
27
30
101
25
36
42
45
47
18
23
26
29
107
32
33
53
69
43
17
108
51
49
50
19
135
115
54
15
141
139
133
39
15
163
120
161
140
162
171
38
41
40
12
12
148
145
144
143
147
146
16
123
20
175
11
15
114
67
13

LAUNDRY SPREADER, COUNTER, AND FOLDER

BACKGROUND OF THE INVENTION

While spreader feeders like those shown and described in U.S. Pat. Nos. 4,031,639 and 3,484,131 have been in common use for laundered articles such as sheets, table linens, and like materials, they are not practical for removing wrinkles from shop towels or other heavy materials after washing and drying of the materials and not only cannot be used to remove wrinkles from the shop towels, but cannot fold, count and stack the towels for use as the wrinkles are removed therefrom.

The spreader feeder of the present invention is especially designed to take towels made from relatively rough heavy material and of a relatively small size, which cannot be spread by spreader feeders of the type disclosed in the aforementioned patents and spread the laundered shop towels or other relatively small cloth articles and remove wrinkles from the towels and then fold and stack the towels to be bundled in bundles of uniform size and of a uniform count. Such an apparatus particularly adapted for shop towels or other rough relatively small cloth materials has never before been successfully attained, making it necessary to use manual labor to spread, fold, count and stack the towels and deliver the towels for use in uniform bundles or stacks.

SUMMARY AND ADVANTAGES OF THE INVENTION

By the apparatus of the present invention, I provide a spreader feeder for rough fabric articles, such as shop towels, wash clothes and the like in which the laundered and dried towels are supplied to an elongated bin having a conveyor movable therealong from one end and side to the other, which serves to progress the articles as dropped into the bin, to be picked up one by one by grippers at the pick up end of the bin, which elevate the articles above the bin along a partition and past a horizontal axis brush, serving to remove wrinkles from the articles and brush excessive articles which may accidentally be picked up, back into the bin.

The grippers release the articles one by one at the upper ends of their paths of travel and over the bin, to be caught by primary catches on a vertical run of a conveyor. Each primary catch has an up-turned outer end catching the article as dropped from the grippers and pulling the article through stationary brushes which tend to drape the article over the primary catch. The primary catches carry the article over a transverse stationary brush and over a retarded rotation brush rotating about an axis transversely of the path of travel of the articles carried by the primary catches. This elongates the article for transfer one by one to a spreader bar, traveling in the direction of the axis of the retarded rotation brush toward the back end of the bin and generally parallel thereto.

The spreader bars are carried by an endless conveyor chain and extend laterally therefrom and each has spaced catches which may be adjacent each end of the spreader bar, to catch the article and remove the article from the primary catch. Each spreader bar upon gripping the article carries the article over the rotatable brush transversely to its direction of rotation and under an elongated stationary brush extending in the direction of travel of the spreader bar and above the article to be spread, to effect spreading of the article and cause the article to drag behind the catches on the spreader bar and be draped over a rotatable counter having a predetermined number of equally spaced radial tines.

Each spreader bar will carry the article past the counter and drape a straightened article over a brush of the brush conveyor each travel of the counter a distance equal to the spacing between the centerlines of the counter tines. As a preselected number of folded articles are draped one over the other on the brush conveyor, the brush conveyor is operated to deliver the stack of articles along an outwardly and downwardly extending guide, engaging the articles along the fold thereof and guiding the articles for discharge into a receptacle, chute or other towel receiving device. The articles may then be manually removed as a counted stack accumulates.

A primary advantage of the invention is the provision of a relatively high speed spreader, counter,folder and feeder for rough fabric articles, such as shop towels, which may be operated with a minimum amount of hand labor at far greater speeds than could be done by hand.

A further advantage of the invention is that laundered rough toweling, such as shop towels and like articles may be taken from a laundering and drying operation and deposited into an elongated bin and progressed to a pick up station where the articles may be picked up one by one and released in elevated relation with respect to the pick up station to be caught by a catch catching a single article and allowing any surplus articles to drop back into the bin.

A still further object of the invention is that wrinkles in the laundered articles may be removed by drawing the articles through a series of brushes and transferring the articles to a spreader bar carrying the article under a brush and draping the article over a counter onto the delivery end of a brush conveyor and stacking the articles on the delivery end of the conveyor and releasing a stack of a predetermined number of articles for discharge into a bin or the like to be packaged or picked up for use.

A further advantage in the invention is that the bin is elongated and has a conveyor moving along each side of the bin and about the ends thereof, to progress articles that may be dropped into the bin or dropped from the pick up to move back to the pick up station and to thereby avoid accumulation of the articles in the bin at the pick up station.

A still further advantage in the invention is that clips or grippers are carried past a pick up station at one end of a bin and brush means release one or more articles from the grippers, where the grippers may pick up more than one article, and thereby enable the surplus articles to drop back into the bin and be progressed thereabout to be again picked up.

Still another advantage in the invention is that a primary catch moves upwardly toward a drop station for the article, and where more than one article may be dropped on the catch, the surplus article is brushed off to fall back into the bin and progressed thereabout.

Still another advantage of the invention is that a counter is provided for counting the spread articles draped thereover and actuating a conveyor at a pick up station, where a counted stack of wrinkle free articles may be delivered for use.

These and other advantages and objects of the invention will appear from time to time as the following specification proceeds and with reference to the accompanying drawings, illustrating one form in which the invention may be embodied.

DESCRIPTION OF THE PREFERRED EMBODIMENT

Figure 1:
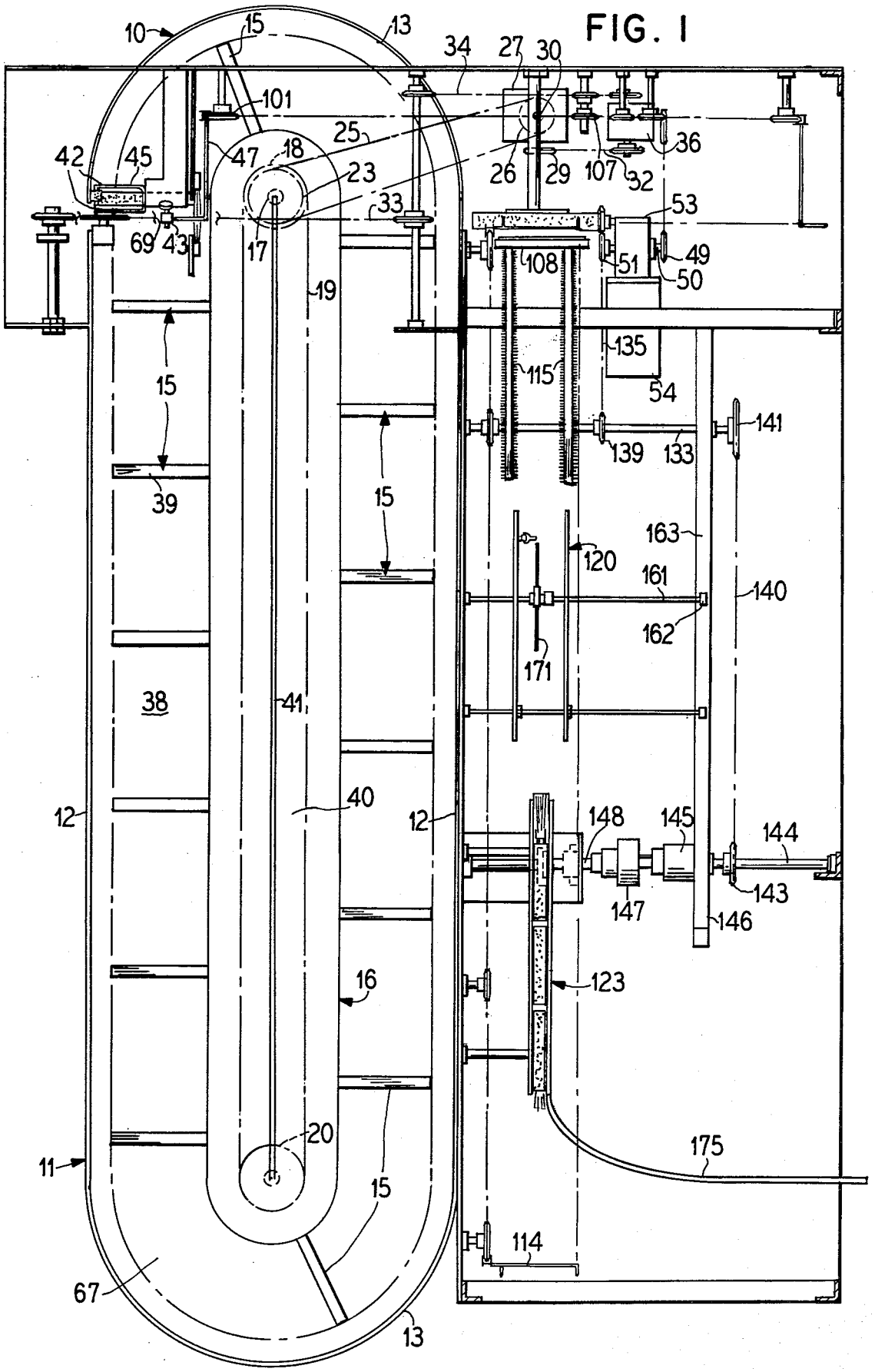
FIG. 1 is a diagrammatic plan view of a device constructed in accordance with the principles of the present invention, with certain parts broken away.

In the embodiment of the invention illustrated in FIG. 1 of the drawings, I have shown a spreader, folder, counter and stacker 10 for small cloth articles of relatively heavy rough material, such as, shop towels. The spreader, folder, counter and stacker generally indicated by reference numeral 10 includes an elongated bin 11 extending for the length of the apparatus and having vertical sidewalls 12 connected together by arcuate end walls 13 spaced outwardly of the paths of travel of flights 15 of a conveyor 16 and conforming to the paths of travel of said flights.

Figure 2:
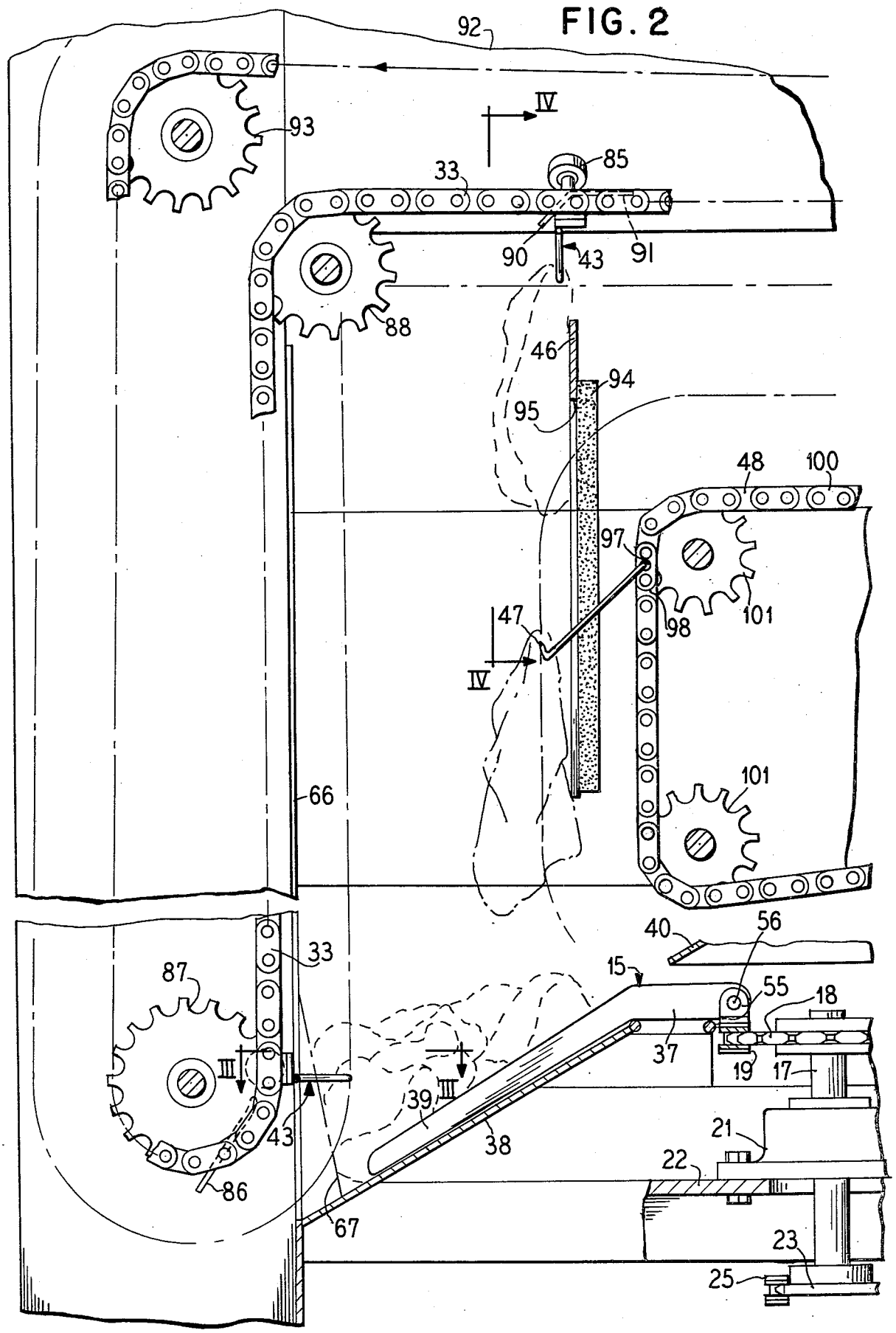
FIG. 2 is a sectional view taken substantially along line II—II of FIG. 1 and illustrating the gripper pick up station and the release station for the shop towels to be dropped and caught for spreading and folding.

The conveyor 16 as diagrammatically shown in FIGS. 1 and 2 is driven from a vertical axis drive shaft 17 having a drive sprocket 18 at its upper end, meshing with and driving a conveyor chain 19, shown as being a roller chain. Said chain extends for substantially the length of said bin and passes about an idler sprocket 20 at the opposite end of said bin from said drive sprocket.

The shaft 17 is suitably journalled intermediate its ends in a bearing support 21 (FIG. 2) mounted on a wall 22 extending across said bin. The driveshaft 17 extends beneath the bearing support 21 and bearing therein (not shown) and is keyed or otherwise secured to a sprocket 23. Said sprocket 23 meshes with and is driven from a drive chain 25, which in turn is driven from a drive sprocket 26 of a right angled drive 27.

Figure 5:
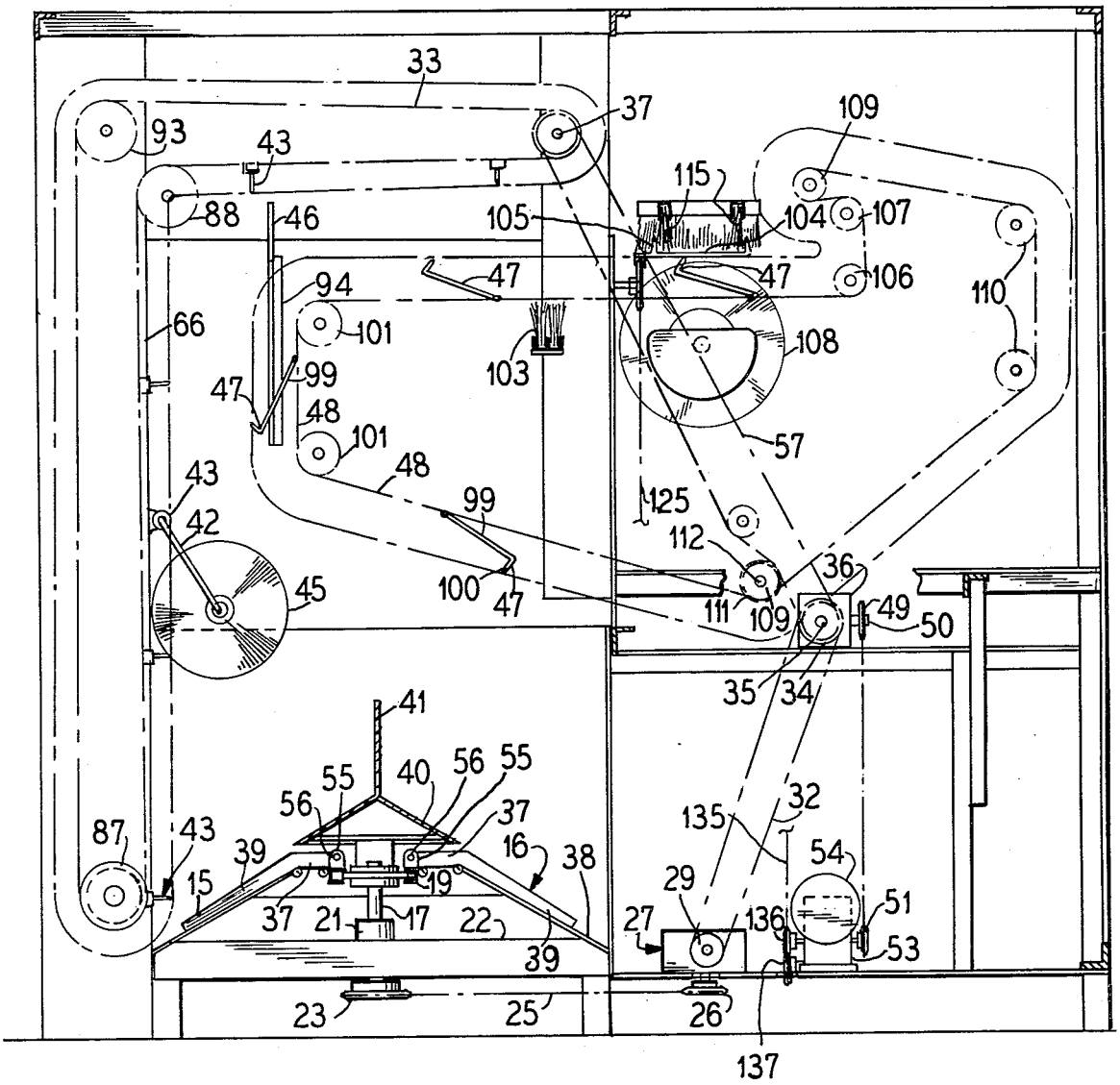
FIG. 5 is a diagrammatic end view of the apparatus with certain parts broken away and certain other parts shown in section, in order to show the transfer and brushing of the shop towel caught by a primary catch through a series of brushing operations to be spread along a spreader bar for further spreading and transfer operations.

The right angle drive 27 may be of a conventional form and is driven from a sprocket 29 and right angled drive gearing (not shown) within the housing for said right angled drive and driven from the sprocket 29. The sprocket 29 in turn is meshed with a chain 32 driven from a sprocket 34 on a shaft 35 of a right angled drive 36, shown in FIGC 5 as being disposed above and outside of the right angled drive gearng 27. The right angled drive earing 27 serves not only to drive the conveyor 16, but also to drive a tl elevating chain 33 through a chain and sprocket drive 57, as shown in FIG. 5.

The right angled gear drive 36 is driven from a sprocket 49 on a horizontal shaft 50, which in turn is driven from a chain and sprocket drive including a sprocket 51 journalled in a gear housing 53 having a drive motor 54 extending therefrom and driving the sprocket 51 on one side of said gear housing and another sprocket 136 on the opposite side of said gear housing.

The flights 15 of the conveyor 16 are pivotally connected to attachments 55 extending upwardly of certain links of the conveyor chain 19, by pivot pins 56. The flights 15 include horizontal portions 37 extending outwardly of the attachments 55 and pivotally connected to said attachments by the pivot pins 56 to accommodate upward movement of said flights should a towel become lodged between an inclined bottom pan 38 of the bin 11, and inclined portions 39 of said flights extending downwardly along the bottom pan or wall 38 of the bin 11 and thereby forming downward continuations of the horizontal portions 37 of said flights.

The flights 15 are covered by a hood 40 extending along the length thereof, and conforming generally to the path of travel of the conveyor and outer ends of the horizontal portions 37 of the flights 15. Said hood 40 has a rib 41 extending therealong and upwardly of the central portion thereof, as clearly shown in FIGS. 1 and 5. The rib 41 and inclined portions of the hood 40 deflect towels thrown into the bin 11 into the paths of travel of the flights 15, to accommodate said flights to progress material along the bin and prevent the material from being caught by the horizontal portions 37 of the flights 15.

It should here be noted that opposite sides of the bottom of the bin 11 are inclined to enable the inclined portions of the flights 15 to carry shop towels or other articles along the bin both when deposited into the bin and when dropping from the towel elevating chain 33 and clip 43 or from a primary catch 47 where more than one towel may fall onto said catch. This assures a continuous supply of rough toweling for spreading, folding, counting and stacking, and avoids the collection of towels in bunches and the dropping of improperly caught towels onto the ground.

Reference is now made to the towel elevating chain 33 which extends upwardly to and about a sprocket 88 and partially across the front of the apparatus and is driven from the chain and sprocket drive 57. The towel elevating chain 33 carries spaced clips 43 picking up towels at the receiving end of the bin 11 and elevating said towels under a retarded rotation brush 45. Said brush 45 may be pivotally mounted on arms 42 which in turn are pivotally mounted on bosses 44 on the inside of a partition 66.

The grippers or clips 43 are actuated to engage or release a towel by cam means as will hereinafter more clearly be described, to drop a towel carried by a clip along the partition 46, to be caught by a primary catch 47, secured to an endless chain 48. The gripping and release operations as well as the operation of the primary catch 47 will hereinafter be more clearly described as this specification proceeds.

The bin 11, at its pick up end has an upwardly and outwardly inclined wall 67, shown in phantom by broken lines in FIG. 2 and having an open portion 69 (FIG. 3) into which the clip 43 extends, to grip and pick up a towel and elevate the towel along a vertical partition or slotted wall 66 along which it is carried under the brush 45 (FIG. 5) serving to brush any surplus towels from said clip and to extend a towel gripped by said clip downwardly of said clip.

Figure 3:
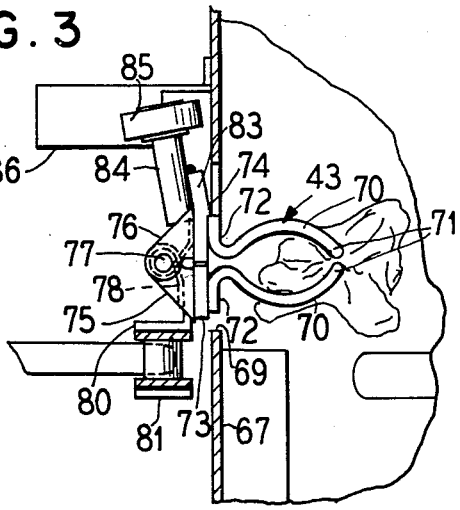
FIG. 3 is a horizontal sectional view taken substantially along line III—III of FIG. 1 and illustrating the pick up of a shop towel at the pick up station.

Referring now to FIGS. 2 and 3 and the construction of the clips 43, each clip includes mating convexly curved pick up fingers 70 having registering ends 71 serving to grip a towel when said clip is in a closed position. The fingers 70 have feet 72 at the opposite ends thereof from the pick up ends 71 and extending generally in the path of travel of the clip and its drive chain 33. The feet or out-turned ends of the fingers 70 are welded or otherwise secured to individual plates 73 and 74. The plates 73 and 74 have mating lugs 75 and 76 extending outwardly therefrom and lapping and pivotally connected together by a pivot pin 77. A torsion spring 79 extends about the pivot pin 77 and has engagement at its opposite ends with the outer sides of the plates 73 and 74, to bias the clip 43 to grab a towel and hold the towel until released. As shown in FIG. 3, the plate 73 has a vertical leg 80 suitably secured to a link 81 of the endless chain 33. The opposite plate 74 has an outwardly extending portion 83 having a shaft 84 welded or otherwise secured thereto and having a roller 85 suitably journalled on its outer end portion.

It will be noted from FIG. 2 that a cam 86 extends along a bottom idler sprocket 87 for the endless chain 33 beneath the axis of rotation of said sprocket and on the opposite side of the sprocket from that shown in FIG. 2. As the clip 43 turns about the sprocket 87, the roller 85 rides therealong to effect pivotal movement of the clip 43 about the axis of the pivot pin 73 against the torsion spring 78. This will effect opening of the clip as it starts to move along its upward path of travel. As the roller 85 moves upwardly beyond the end of the cam 86, as shown in FIG. 2, the torsion spring 76 will close the clip to effect gripping of a towel at the gripping ends 71 of the mating fingers 70. The endless chain 33 will then move the clip 43 and towel upwardly under the brush 45 to a direction changing sprocket 88 changing the direction of the chain 33 to move laterally across the front of the bin 11 in an elevated position. It should be understood that during movement of the clip 43 under the brush 45, the brush 45, being biased to exert brushing pressure on the towel will not only serve to draw out or straighten the towel, but will also brush any excess towels from the clips 43 as they pass under said brush. Any excess towels accidentally picked up will drop back into the bin 11, to be carried thereabout by the conveyor 16.

Figure 4:
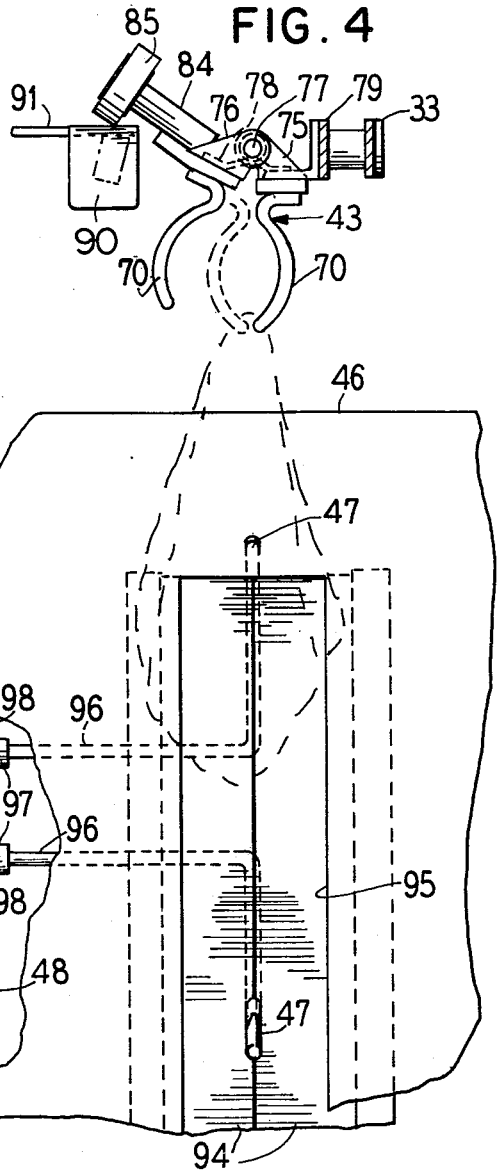
FIG. 4 is a fragmentary view illustrating the release of a shop towel from the cam control gripper, at an elevated part of the apparatus to be dropped and caught by a primary catch and carried through an initial spreading operation.

An inclined cam plate 90 is mounted on the end of an arm 91 (FIG. 4) in position to engage the roller 85 and effect opening movement of the clip 43 to release the towel gripped thereby to be caught by a primary catch 47 and drawn horizontally between a pair of mating brushes 94 carried in an open portion 95 of the partition 46 and extending vertically therealong (FIG. 4).

The arm 91 is shown as mounted on and extends inwardly of the sidewall 92 of the apparatus and is shown in dotted form in FIG. 2 and in full in FIG. 4.

While only two clips 43 are illustratively shown in FIGS. 2 and 5, it should be understood that any number of clips may be spaced along the chain 35 and it is intended that the clips 43 be uniformly spaced along the chain 33 in accordance with the rate of speed at which the towels are to be gripped and deposited on the primary catches 47 to be carried thereby for spreading. Usually, the clips are so spaced that each time a primary catch 47 projects between the brushes 94, a clip 43 will be in position to release a towel.

The endless chain 33 on its return run passes about a drive sprocket 89 of the chain and sprocket drive adjacent one side of the apparatus and outwardly of the partition 66 about the direction changing idler 93. From thence, said endless chain passes downwardly to and about the idler 87 about which it changes its direction as the clip 43 grips the towel and draws the towel upwardly beneath the brush 45.

The primary catches 47 as spaced along the endless chain 48 are each shown as including an arm 96 fixedly mounted on an attachment 97 on a link 98 of said endless chain to remain in fixed relation with respect to said chain in all positions of travel thereof (FIGS. 2, 4 and 5). The primary catch 47 includes the relatively long arm 99 extending outwardly of the attachment 97 and having a relatively sharp catch 47 extending therefrom in position to catch a towel as moving vertically between brushes 94. The endless chain 48 passes about vertically spaced idlers 101, 101 to provide a vertical run moving said primary catch in the space between the brushes 103, facing each other and carried in the partition 46, and drawing the towel in the space between said brushes. Said brushes are spaced relatively close together to place a drag on the towel and elongate the towel from the catch, as well as remove wrinkles therefrom as passing between said brushes and along a horizontal transfer run of said endless chain 48. Said endless chain 48 passes over spaced spreader brushes 103 and then passes beneath a spreader bar 104 and carries the primary catch beyond said spreader bar 104, to deposit the towel on spaced trailing hooks 105, 105 extending from said spreader bar and depending therefrom, in the position shown in FIG. 6. As the primary catch has deposited and spread the towel on the spaced hooks 105 of the spreader bar 104, the endless chain 48 and attachment 97 fixedly attaching the elongated arm 96 of said primary catch 47 to the endless chain 48, mounts said catch on said chain at a retreating angle, to pass about a direction changing sprocket 106, et 109 and outwardly therefrom about a pair of vertically spaced sprockets 110, and angularly and inwardly from the lowermost of said sprockets 110 under a drive sprocket 111 on a transverse shaft 112. The chain 48 then extends upwardly and under the lowermost idler sprocket of the idlers 101. From the lowermost idler 101, the endless chain 48 extends upwardly along the insides of the brushes 103 carried in the partition 46 and about the uppermost of said idlers and horizontally therefrom, as previously described. As the endless chain 48 passes under a spreader bar 104, it is spaced to one side of a retarded rotation brush 108 and draws the towel along the circumferential surface thereof to enable the towel to be spread along the spreader bar, as shown in FIGS. 5 and 6.

The spreader bar 104 on a conveyor chain 125 will draw the towel transversely of the brush 108 in the direction of the axis thereof and beneath relatively long spaced stationary brushes 115 (FIGS. 1 and 7) placing a drag on the towel, and draping the towel over the side frame members 119 of a counter 120.

Figure 7:
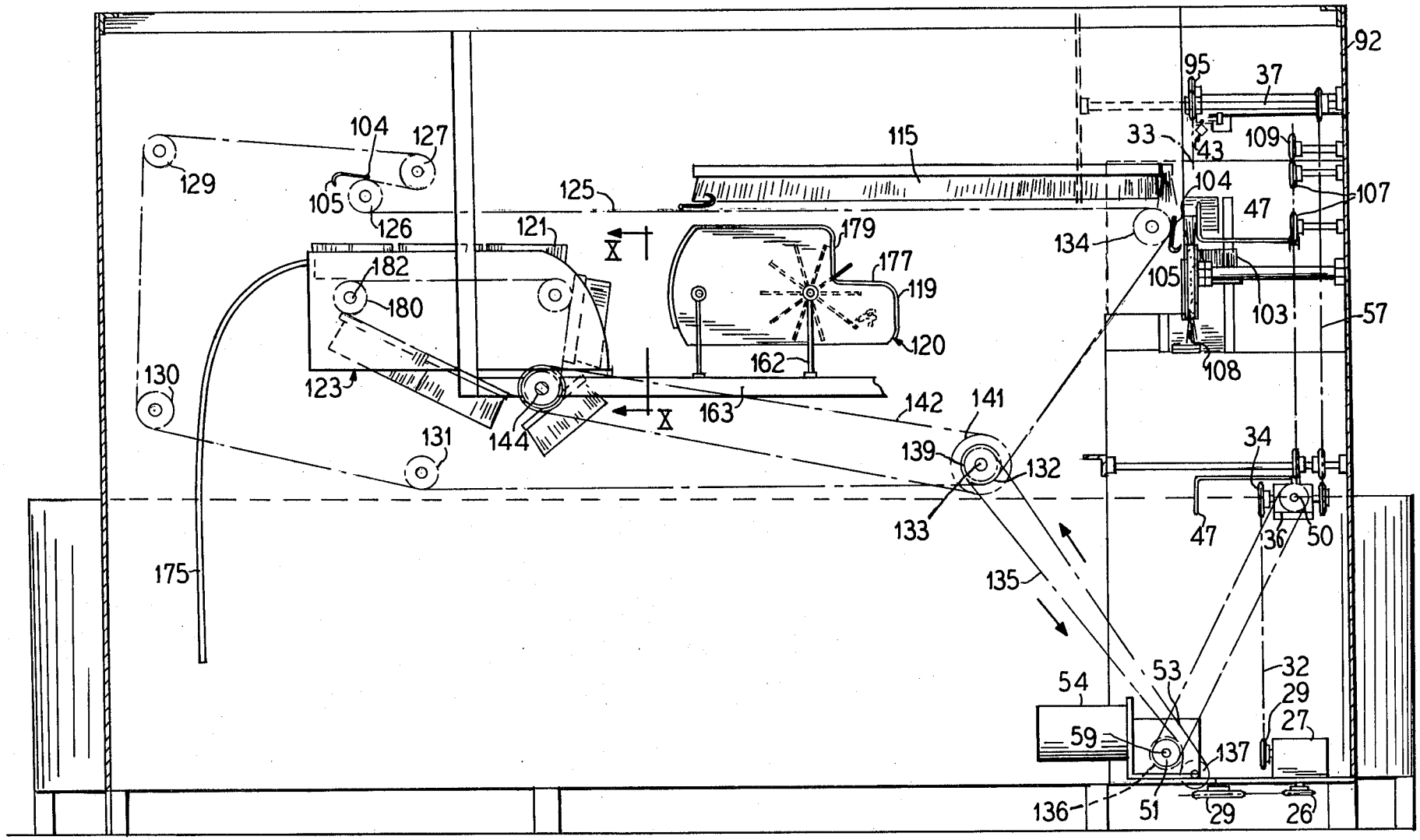
FIG. 7 is a diagrammatic side view of the apparatus illustrating the paths of travel of the spreader bars carrying the shop towel past a counter, and depositing the shop towel on a brush conveyor to be stacked adjacent the discharge end of the conveyor and discharged for use.
Figure 8:
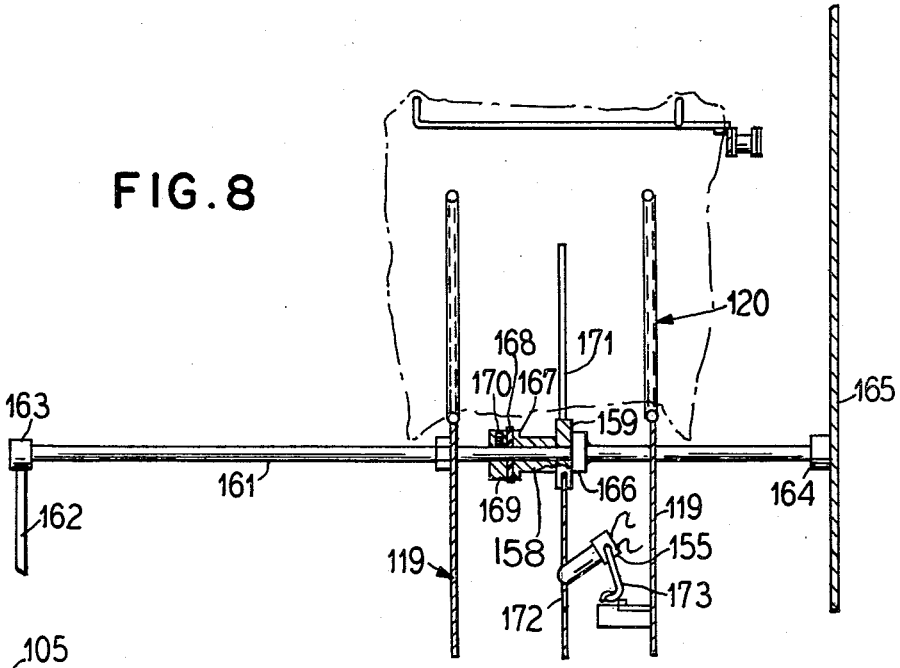
FIG. 8 is a diagrammatic transverse sectional view taken through the counter, illustrating the mounting of the counter tines and the switch means for actuating the brush conveyor, to move a distance of one brush at the termination of a counting operation and the discharge of a stack of predetermined number of shop towels on the brush conveyor.

The hooked ends 105 of the spreader bar 104 also drape the towel along opposite sides of brushes 121 of a brush conveyor 123. The towels will be released as the chain 125 carrying the spreader bars turns about an idler 126 turning the spaced hooked ends 105 of the spreader bar into a release position (FIG. 7). The spreader bar will then reverse its direction of travel about an idler 127 free from its towel in a return path about idlers 129 and 130. From the idler 130 the chain 125 will pass toward the front of the machine under an idler 131 to and under a drive sprocket 132 on a transverse shaft 133. From thence, the chain 125 will pass angularly upwardly to and about the idler 134 to provide a horizontal run from the brushes 115 to the idler 126.

Figure 6:
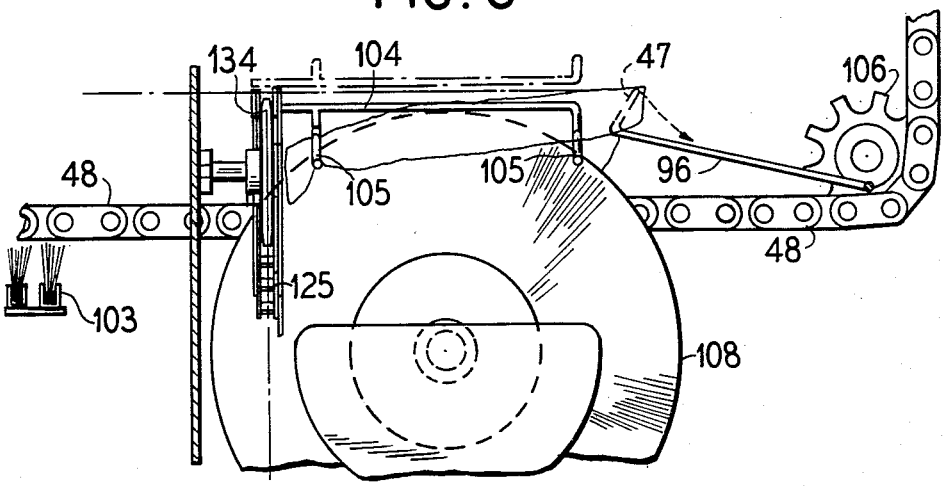
FIG. 6 is an enlarged diagrammatic fragmentary sectional view, illustrating the transfer of a shop towel to a spreader bar to be drawn through and beneath a series of brushes prior to counting, folding and stacking for discharge for use.

It should be understood from FIGS. 6 and 7 that the chain 125 is a single run chain and the spreader bars are attached to certain links of the chain by suitable attachments (not shown) and extend outwardly therefrom in equally spaced relation with respect to each other and in cantilever relation with respect to the chain 125.

It should also be understood that while only three spreader bars are shown, the spreader bars may be equally spaced along the chain 125 to effect continuous stacking of the towels in stacks of predetermined numbers onto the brushes of the brush conveyor 123.

The sprocket 132 forms a drive sprocket for the chain 125 and is keyed or otherwise secured to a driveshaft 133 suitably journalled in a side frame member of the apparatus and driven from an endless drive chain 135. The chain 135 is partially wrapped about a drive sprocket 136 on the transverse shaft 59 of the speed reducer 53.

From the sprocket 136, the chain passes about a sprocket 137 reversing the direction of travel of the chain. The sprocket 137 serves as a take up sprocket and may be adjustable toward and from a vertical plane extending through the axis of the drive shaft 57 to take up tension on the chain. The adjustable mounting for the sprocket 137 is not herein shown since tension may be taken up on the chain by other take up sprockets (not shown) in a conventional manner, well known to those skilled in the art so not herein shown or described further.

The drive to the brush conveyor 121 is through a sprocket 139 keyed or otherwise secured to the shaft 133, driven by the endless chain 135.

A sprocket 141 is also keyed or otherwise secured to the shaft 133 and serves to drive a sprocket 143 keyed or otherwise secured to a transverse shaft 144 journalled in a bearing support means 145, secured to and extending inwardly of a frame member 146, forming a support for the brush conveyor 123. The bearing housing 145, forming a bearing support for the shaft 141 may contain suitable bearings for said shaft (not shown) and supporting said shaft to extend within a clutch 147, which may be a magnetic clutch, energized to provide a drive to a shaft 148 for the brush conveyor. The shaft 148 extends from the clutch 147 through a bearing housing 149 mounted on a support frame structure 150 for a plate 151 of the brush conveyor. The end of the shaft 148 opposite the bearing housing 149 is suitably journalled in a bearing housing 152 mounted on and extending inwardly of a side frame member 153 of the apparatus. The shaft 148 has a sprocket 155 keyed or otherwise secured thereto meshing with and driving an endless chain 156 of the brush conveyor.

As shown in FIG. 7, the endless chain 156 has a plurality of elongated brushes 121 mounted thereon and extending outwardly therefrom. Each brush 121 is of substantially the length of a towel folded thereover and is adapted to exert a retarding effect on the first towel folded thereover to accommodate ready release of the towel from the spreader bar 114.

The clutch 147 may be a well known form of electric clutch, such as a magnetic clutch, engaged by operation of a limit switch 155 of the counter 120 to energize said switch. The limit switch 155 may be a well known form of mercury switch, tilted by an elongated tine 172 of the counter 120 upon the stacking of a preselected number of towels on the brushes 121 of the brush conveyor 123.

The counter 120 and its operation and function will now be described. The counter 120 includes a disk 159 mounted on a stationary transverse shaft 161 extending between the parallel sidewalls 119 of the counter and therebeyond. The shaft 161 is secured at one end to an upright stand 162, extending upwardly of a frame member 163, which may support both the counter 120 and the brush conveyor 123. The outer end of the shaft 161 is mounted in a boss 164 which may be secured to a side frame member 153 of the apparatus.

A collar 166 is welded or otherwise secured to the shaft 161 and is abutted by the disk 159. A sleeve 156 extends from the opposite side of said disk from the collar 166 and has an inner flanged end 167 abutting a friction disk 168. The collar 169 may be placed into abutting engagement with the friction disk 159 and pressed into engagement therewith to effect a drag in rotation of the disk 159 and the counting fingers or tines projecting radially therefrom. A set screw 170 threaded in the collar 169 is provided to hold said collar from rotation and thereby enable the required drag to be placed on the disk 159.

The disk 159 has a plurality of tines or thin non-flexible spokes 171 extending radially therefrom and spaced an equal distance apart and a switch actuating tine 172. The tine 172 is spaced equally of the tines 171 and is longer than the tines 171. Said tine 172 serves to engage the bulb of the mercury switch 155 and tilt said switch about its axis of connection to a support 173, to establish an energizing circuit to the electric clutch 147 in a well known manner. Energization of said clutch will effect a drive to the brush conveyor 123 a distance sufficient to discharge a stack of counted towels determined by the number of tines extending radially of the disk 159 downwardly along a guide rod 175 engaging the towels at the fold thereof and guiding the towels for discharge in a counted stack onto a pick up station, which may be a conveyor (not shown), a flat plate or other surface receiving separated and counted stacks of towels to be taken away from the apparatus for use.

Figure 9:
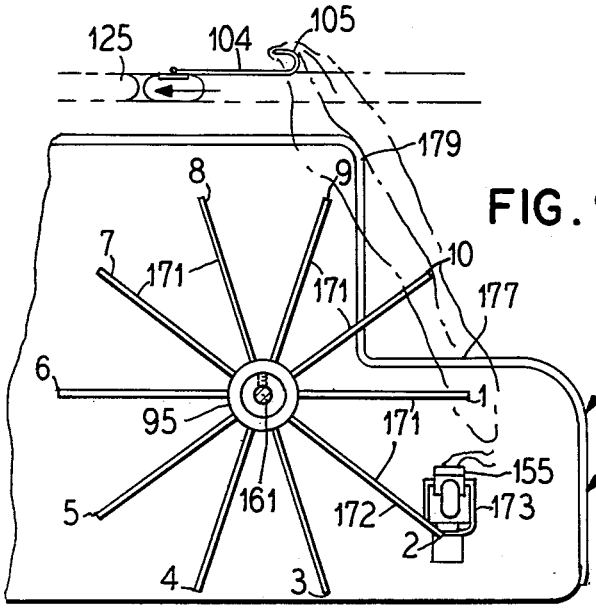
FIG. 9 is a side view of the counter illustrating the amounting of the counter disk on its shaft, the operating means for the limit switch, and the draping of shop towels one by one over the counter, to effect a counting operation each time a towel passes thereby.

As shown in FIGS. 7 and 9, ten tines including the tine 172 extend radially of the disk 159. The tine 172 will come into engagement with the mercury switch 155 to tilt said switch and energize the electric clutch 147 at a count of ten stacked towels and thereby effect a drive to the brush conveyor 123 a distance sufficient to discharge the stack of towels along the guide rod 175 with the fold of the stack engaging the rod 175.

It should be understood that the spreader bars 104 may be spaced along the endless chain 125 in accordance with the width of the towels spread thereby and draped or folded over the counter 119, and that the spacing of said spreader bars shown in FIG. 7 is for illustrative purposes only, and depends not only upon the width of the towels to be stacked but also the number of stacks and the speed of travel of the chain 125.

It should further be clear that the side plates of the counter have beaded leading edges and tops as indicated by a reference numeral 177 to assure the freedom of sharp edges which may catch the towels and that the leading edges of said side plates have rectangular recesses 179 therein spaced above the axis of the stationary shaft 161 to provide an opening into which the tines move as they move about the axis of said shaft 161 and are moved out of said opening in a counterclockwise direction by a folded towel moved therealong by its spreader bar.

Any towel not properly spread across the plates or sidewalls 119 and hanging along the opposite sides of said sidewalls will not be counted and will be released from the spreader bar as it turns about the sprocket 126. A suitable receptacle may be provided to receive any such towels.

The brush conveyor 123 in advance of the counter 119 and beneath the direction changing sprocket 126 and spreader bar 114, as it turns about said sprocket, will receive a towel on the brushes at the discharge end of the conveyor. The towel is draped along the sidewalls of said conveyor and is released to uniformly drape along the sidewalls of the conveyor as the spreader bar is in the position shown in FIG. 9, to drape along the sidewalls of the conveyor into alignment with the guide rod 175. As ten towels are stacked on the leading brushes of the brush conveyor, the mercury switch 155 will be tilted by the tine 172 to complete an energizing circuit to the magnetic clutch 147 to effect a drive to the shaft 148 and the brushes of said brush conveyor. One stack of towels will then pass along the rod 175 to be picked up in a stack, herein shown as being a stack of ten towels.

Figure 10:
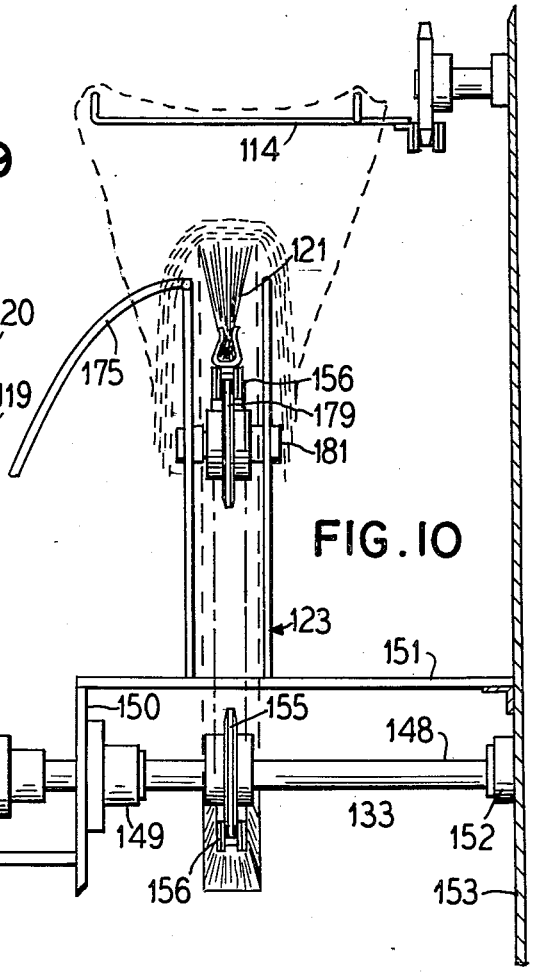
FIG. 10 is a fragmentary transverse sectional view taken through the brush conveyor, and illustrating the draping of shop towels thereon, and also illustrating the drive to this conveyor energized by the counter actuated limit switch.

It should further be noted that the sidewalls of the brush conveyor are relatively closely spaced and the brushes are relatively narrow. Idler sprockets 178 and 180 are mounted between said sidewalls on shafts 181 and 182 respectively while the drive sprocket 155 driven from the shaft 148 is disposed beneath a support plate 151 for the conveyor. This construction is best shown in FIGS. 7 and 10.

In operation of the apparatus and summarizing the previous description, the laundered and dried towels are dropped into the bin 11 to be picked up by the clips 43 at a pick up station 14 as shown in FIGS. 1, 2 and 5. The towel or towels which may be picked up by the clips 43 are then elevated beneath the rotatable brush 45, mounted to bear against the towels and not only remove wrinkles therefrom but also to effect brushing of any surplus towels that may accidentially be picked up back into the bin 11. The towels dropping back into the bin 11 are carried thereabout by the flights 15. As the clips 43 approach the upper ends of their paths of travel, they change their direction from vertical to horizontal inward movement toward the partition 46. At this portion of the cycle, the cam 88 will open each clip 43 as it passes therealong to drop the towel along the outside of the partition 46, to be caught by a primary catch 47. Should more than one towel be dropped, only one will be caught by the primary catch, while the other will drop back into the bin 11 and be progressed thereabout by the flights 15 of the conveyor. The primary catch 47 in fixed angular relation with respect to its endless chain 98 will turn about a direction changing sprocket 101 bringing the primary catch and towel between the brushes 94 and across the front of the apparatus. During movement of the towel across the front of the apparatus, it will be drawn over the stationary brush 103 which will further spread the towel and place it in condition to be drawn along the retarded rotation brush 108. As the towel passes over the retarded rotation brush 108, it will be picked up by the spaced hooks 105 of the spreader bar 104 and carried beneath spaced brushes, further spreading the towel to be draped along opposite side plates 119 of the counter 120 and moved into the right angled recessed portions 179 of said sidewalls into engagement with a tine 171 to turn the disk 163 against the frictional resistance offered between the friction disk 168 and collar 165, a distance sufficient to count the passage of one towel past the counter. As the towels pass the counter 120, the spreader bar continues to spread the towels, to be draped over the brushes 121 of the brush conveyor 123 and stacks a counted stack of towels on said brush conveyor.

At this time, the tine 172 will have engaged and tilted the mercury switch 155 about its axis of connection to the bracket 173, and an energizing circuit will be established to a magnetic clutch 147 to effect a drive from said clutch to drive the brush conveyor from the shaft 149.

It should here be understood that the spreader, counter, folder and stacker are all carried in a frame structure relatively open along the sides thereof and that the respective sprockets are mounted on the shafts extending inwardly of a sidewall 180 of the frame structure. The frame structure described as being open may be closed during operation of the apparatus to prevent the catching of a persons clothes in the numerous chains and sprockets of the apparatus. Doors (not shown) may also be provided to accommodate removal of the folded towels and the uncounted towels discharged from the spreader bar at the discharge station, and to accommodate the placing of towels into the bin 11 to effect a continuous circulation of towels about said bin as long as towels are present to be spread, folded, counted and stacked, and that the bunching up of the towels at the pick up station is avoided by keeping the towels in continuous motion about the bin 11 as dropped thereinto by the brushes 45, or 103.

The present apparatus may fold and stack as many as 3,200 towels per hour although the brushing of towels from the clips or primary catches may reduce this output.

It should further be understood that the showing of the apparatus is diagrammatic only, and that many of the supports for the sprockets and the shafts and bearings are not mentioned for the purpose of simplicity.

Further, a single motor drives all of the operative parts of the apparatus, and the various gear boxes shown may contain reduction or step up gearing (not shown) driving the respective endless chains 33, 48 and 125 so that as a clip 43 is in overhead release position, a primary catch 47 will move upwardly between the brushes 94 into position to catch an article released by the clip 43, and draw the article between the brushes 94 and over the brush 103 and along the circumferential surface of the brush 108, and at the same time deposit the article on the trailing hooks 105 of the spreader bar 104, as shown in FIG. 6. This effects spreading the article as the article is moved across said brush in the direction of the axis thereof, and further spreads the article by the brushes 115, to be draped over the counter 120 and brush conveyor 123 for stacking and release as the hooks are inverted by reversal in the direction of travel of the chain 125 as it starts its return run. It is of course obvious that the drive and operative parts shown may be varied, without departing from the novel concepts of the invention, as long as the operative parts move in proper timed relation.

I claim as my invention:

1. A spreader, counter, folder and stacker for rough laundered articles comprising:

a receiving bin for the laundered articles having a pick up station, means progressing the laundered articles about said bin at least to said pick up station, gripper means at said pick up station, gripping an article and elevating the article to an elevated discharge station, means at said elevated discharge station for releasing the article gripped by said gripper means, catch means catching a released article, brush means adjacent said catch means, said catch means drawing the article past said brush means, to effect spreading of the article, a spreader bar at the opposite side of said bin from said catch means and adapted to have an article spread therealong and deposited thereon by said catch means, means brushing the article as moved by said catch means along said spreader bar, to be deposited thereon, said means brushing the article in position to have the article drawn therealong by said spreader bar after deposit thereon by said catch means, a counter and stacking conveyor in series disposed beneath the path of travel of said spreader bar and adapted to have the article draped thereover during operation of said counter and have the article draped on said brush conveyor to be successively stacked on said brush conveyor, and means actuated by said counter effecting a drive to said brush conveyor upon the stacking of a preselected group of articles thereon.

2. The spreader, counter, folder and stacker of claim 1, including an endless chain moving at an angle with respect to said catch means and moving said spreader bar above and along said counter and said discharge conveyor, wherein a plurality of spaced spreader bars are mounted on said endless chain and extend outwardly therefrom over said counter and discharge conveyor, wherein said spreader bar has means thereon carrying an article with said spreader bar, and means are provided to drive said chain and spreader bars at a constant rate of speed, wherein a direction changing sprocket is provided for said endless chain and meshes therewith above said discharge conveyor and is positioned to invert said spreader bar and effect the release of an article for discharge onto said discharge conveyor, and effect the stacking of articles on said conveyor one on top of the other, and wherein switch means are provided operable by said counter upon the stacking of a preselected number of articles on said conveyor for establishing a drive to said conveyor to discharge the stacked articles thereon in position to be picked up for use.

3. The spreader, counter, folder and stacker of claim 1, wherein the counter includes a rotatable disk having a predetermined number of tines extending radially therefrom, determined by the number of articles to be stacked and wherein said switch means is a limit switch operated by a tine determining the last article to be counted and effecting a drive to said conveyor means for discharge of a stack of articles for use.

4. The spreader, counter, folder and stacker of claim 3, wherein the tines extending from said disk are relatively stiff and the tine determining the number of articles to be stacked is longer than the others, and said limit switch means is a mercury switch tilted by said tine determining the number of articles to be stacked.

5. The spreader, counter, folder and stacker of claim 4, including bracket means for said mercury switch pivotally mounting said mercury switch to be moved in a circuit energizing position and in the path of the tine determining the count of articles to be delivered to said conveyor, to effect a drive to said conveyor.

6. The spreader, counter, folder and stacker of claim 5, wherein friction means are provided to retard rotation of said disk and tines, and said conveyor at the discharge end of said counter is a brush conveyor.

7. The spreader, counter, folder and stacker of claim 6, including a rod extending downwardly and outwardly of said conveyor from the discharge end thereof and guiding the stack of folded articles discharged by said conveyor in position to be picked up for use.

8. A spreader, counter, folder and stacker for rough toweling and like laundered articles comprising:

an elongated bin having a conveyor movable therealong in a continuous path from one end to the other and having a pick up station past which toweling is progressed by said conveyor, gripper means at said pick up station comprising at least one clip biased into a gripping position, an endless chain carrying said clip above said pick up station, cam means at said pick up station opening said clip and accommodating closing of said clip to grip a towel, said endless chain elevating said clip and moving said clip horizontally over said bin in an elevated position, a primary catch movable across the front of said bin, other cam means in vertical alignment with said primary catch to release said clip and drop an article to be caught by said primary catch, a pair of meshing brushes in the path of travel of said primary catch and through which said primary catch is moved and drawing an article caught by said catch through said brushes and accommodating said brushes to brush excessive articles which may drop onto said catch to be dropped therefrom and fall into said bin, a retarded rotation brush in the path of travel of said primary catch and brushing and spreading articles drawn therealong by said primary catch, and a spreader bar moving at right angles to said primary catch and having trailing towel carrying means extending therefrom away from the direction of travel of said spreader bar and in position to have an article placed thereon by said primary catch as the article is drawn along said brush and carrying the article over said brush in the direction of the axis of rotation of said brush for spreading the article and carrying the article for counting, folding, stacking and release from said spreader bar into a stack of a predetermined number of articles.

9. The spreader, counter, folder and stacker for rough toweling and like articles of claim 8, including an endless chain carrying at least one spreader bar and having said spreader bar projecting therefrom, means driving said endless chain and primary catch to travel at right angles with respect to each other, a counter, disposed beneath said endless chain and in the path of travel thereof, counting the articles drawn therealong, and a conveyor in advance of said counter along which the articles are folded and stacked into a stack of a predetermined number of articles as discharged from said spreader bar.

10. The spreader, counter, folder and stacker of claim 8, in which the bin has parallel side walls and semicircumferential end walls and an inclined bottom wall inclined downwardly from said conveyor to said end and side walls, a vertical axis drive sprocket at one end of said bin and a vertical axis idler sprocket at the opposite end of said bin, an endless chain meshing with said sprocket, and upright fixtures on said chain, flights pivoted to said fixtures and extending from said fixtures to and along said inclined bottom walls, drive means for said drive sprocket and chain, and an abutment wall having an opening therein through which said clips move to accommodate the collection of articles to be gripped by said clips and moved upwardly therealong and inwardly over said primary catch.

11. The spreader, counter, folder and stacker of claim 10, in which said clips each include a pair of mating convex gripper arms pivoted for movement about an axis parallel to the direction of travel of said gripper, plates forming bases for said clips and having lapping lugs extending therefrom a pivot pin pivotally connecting said plates for movement thereabout, a torsion spring on said pivot pin engaging said plates at its opposite ends and biasing said clips into a clipping position, a roller extending outwardly of one of said plates, and cam means in the path of travel of said roller to effect opening of said clips and closing of said clips by said torsion spring to effect the gripping of an article by said clips as said clips move therealong.

12. The spreader, counter, folder and stacker of claim 11, wherein an apron extends over and along said conveyor movable horizontally along said bin, and a rib extends along the top of said apron to deflect articles which may be dropped into said bin to be progressed about said bin by said conveyor and prevent the collection of articles in said bin at the article collecting end thereof.

13. The spreader, counter, folder and stacker of claim 8, in which the clips are mounted on and extend from an endless power driven chain, primary catches are also mounted on and driven from a separate endless power driven conveyor chain at right angles with respect to said chain carrying said clips, and project angularly from said conveyor chain, in position to catch an article released by a clip during movement of each clip to a release position, and spreader bars are mounted on and project laterally from a second endless power driven conveyor chain traveling in a right angle path with respect to the path of movement of said endless chain carrying said primary catches, and a single motor and reduction gearing driven thereby including chain and sprocket drives is provided to drive said endless chains in timed relation with respect to each other, to bring a primary catch in position to catch an article released by said clip and to bring said spreader bar in position to accommodate said primary catch to deposit a spread article thereon without interruption in travel of said endless chains, and a counter and a stacking and discharge conveyor are provided in series, and a drive is provided from said motor including switch means and magnetic clutch means actuated by a predetermined count of articles passing over said counter to effect a drive to said stacking and discharge conveyor upon the stacking of a predetermined number of articles thereon.

14. The spreader, counter, folder and stacker of claim 13, in which the counter has two relatively closely spaced parallel plates disposed beneath and in alignment with the line of travel of said spreader bar, a shaft extending across said plates, a disk mounted on said shaft, friction means retarding rotation of said disk, a plurality of equally spaced radial tines extend from said disk, a tine determining the last article of the stack of articles being longer than the other tines, a limit switch actuated by said longer tine effects a drive to said stacker and discharge conveyor as the article engages a tine and rotates said disk a distance equal to the space between the center lines of two of said tines, and the limit switch is mounted on the inside of one of said side walls into position to be engaged by the longer of said tines and establish an energizing circuit to said conveyor and to de-energize said energizing circuit as an article is drawn by the longer of said tines.

15. The spreader, counter, folder and stacker of claim 14, in which the stacking conveyor is a relatively narrow brush conveyor and the spreader bar drapes the articles to extend along opposite sides of said brush conveyor and stack the articles thereon as released by said spreader bar.

16. The spreader, counter, folder and stacker of claim 15, including a guide bar extending forwardly and downwardly and outwardly of the discharge end of said brush conveyor and engaged by the bottom article of a stack of articles along the fold thereof and discharging the folded stack of articles in position for use.

17. The spreader, counter, folder and stacker of claim 15, in which the side plates of said counter have recessed advance end portions into which the tines move, and the article carried by said spreader bar moves into said recessed portion to engage a tine as passing therealong and draped along opposite of said side plates by said spreader bar.

* * * * *